US005522677A

United States Patent [19]

Schlecht

[11] Patent Number: 5,522,677

[45] Date of Patent: Jun. 4, 1996

[54] TRAVELLING CONCRETING DEVICE

[75] Inventor: Karl Schlecht, Filderstadt, Germany

[73] Assignee: Putzmeister-Werk Maschinenfabrik GmbH, Aichtal, Germany

[21] Appl. No.: 387,894

[22] PCT Filed: Jun. 16, 1993

[86] PCT No.: PCT/EP93/01529

§ 371 Date: Feb. 21, 1995

§ 102(e) Date: Feb. 21, 1995

[87] PCT Pub. No.: WO94/04792

PCT Pub. Date: Mar. 3, 1994

[30] Foreign Application Priority Data

Aug. 19, 1992 [DE] Germany ..... 42 27 364.1

[51] Int. Cl.[6] ..... E21D 11/10

[52] U.S. Cl. ..... 405/150.2; 239/165; 417/900

[58] Field of Search ..... 405/150.2; 239/159, 239/165, 175, 176; 417/900; 169/24, 25

[56] References Cited

U.S. PATENT DOCUMENTS

| | | | |
|---|---|---|---|
| 3,212,604 | 10/1965 | Garnett | 169/24 X |
| 3,367,280 | 2/1968 | Bennett et al. | 417/900 X |
| 3,860,175 | 1/1975 | Westerlund et al. | 239/165 |
| 4,130,134 | 12/1978 | Castle | 405/150.2 X |

FOREIGN PATENT DOCUMENTS

| | | | |
|---|---|---|---|
| 0432854 | 6/1991 | European Pat. Off. . | |
| 1232182 | 1/1967 | Germany . | |
| 2052889 | 5/1972 | Germany . | |
| 2055228 | 5/1972 | Germany . | |
| 2165889 | 6/1973 | Germany . | |
| 2361968 | 6/1975 | Germany | 405/150.2 |
| 2752605 | 6/1979 | Germany . | |
| 3445889 | 6/1986 | Germany . | |
| 3623631 | 8/1987 | Germany . | |
| 3801003 | 7/1989 | Germany . | |
| 329318 | 11/1972 | U.S.S.R. . | |
| 369234 | 11/1973 | U.S.S.R. . | |

*Primary Examiner*—David J. Bagnell
*Attorney, Agent, or Firm*—Flynn, Thiel, Boutell & Tanis

[57] ABSTRACT

The invention relates to a concreting device with a rotary column (16) pivotable on a chassis (10) about a vertical axis (14), a distribution mast (18) pivotable about a horizontal axis (20) on the rotary column (16) and having at least two extended pole arms (24, 24', 24", 24'") which are movable relatively to one another, a distributor arm (26) articulated on the free end of the distribution mast (18) and a conveyor line (32, 32') for the concrete extending along the distribution mast (18) from the rotary column (16) to the distributor arm (26). In order to be able to use the concreting device even on low tunnel work sites, the distribution mast (18) consists of at least two longitudinally telescopic pole arms (24, 24', 24'", while the distributor arm (26) is fitted on the distribution mast (18) to rotate about a transverse axis (30) perpendicular to the telescopic axis and about a longitudinal axis (28) perpendicular thereto. The conveyor line (32, 32'), which is at least partly a flexible hose, can be automatically wound on a hose drum (38) fitted on the rotary column (16) and wound off it in accordance with the telescopic extension of the distribution mast (18).

11 Claims, 5 Drawing Sheets

TRAVELLING CONCRETING DEVICE

FIELD OF THE INVENTION

The invention relates to a concreting device with a rotary column rotatable about a vertical axis on a chassis, a distribution mast pivotal about a horizontal axis on the rotary column and has at least two elongated mast arms which are movable relative to one another, a distributor arm hinged to the free end of the distribution mast, and a conveyor line for the concrete, which conveyor line extends from the rotary column to the distributor arm along the distribution mast.

BACKGROUND OF THE INVENTION

Concreting devices of this type are mainly designated for feeding concrete into tunnel forms which have several closable feed openings distributed in a longitudinal direction and a circumferential direction of the path, which feed openings are loaded with concrete through the concreting device by means of a mouth piece arranged at the end of the distributor arm. In order to simplify and accelerate this operation, it is known to design the distribution mast as a two-arm or a three-arm collapsible mast, the mast sections of which can be aligned with one another in the extended position during operation and can be folded against one another during transport. In order to be able to connect the mouth piece of the conveyor line also to differently aligned feed pipes of the form, the distributor arm can be pivoted both about the transverse axis and also about the longitudinal axis of the mast section oriented on the side of the end. By suitably arranging the operating joints and suitably dimensioning the mast sections, it is possible to utilize the concreting device also in relatively low ceiling tunnel structures. However, the lower the unfolding height of the mast sections, the smaller is the reach of the distribution mast in longitudinal direction of the path. Thus, there are limits regarding the operating height, which in the case of the known concreting device with a collapsible mast lie at approximately 4 to 5 m.

SUMMARY OF THE INVENTION

Starting out from this, the basic purpose of the invention is to provide a concreting device of the above-identified type which, in spite of a relatively long reach, can be utilized in low ceiling tunnel structures.

The solution of the invention is based on the thinking that with a distribution mast, which is exclusively assembled of mast sections, which can be telescopingly connected to one another, no unfolding and thus no additional unfolding height is needed, which limits the workable tunnel height in downward direction. Thus, it is suggested according to the invention that the distribution mast consists of at least two longitudinally telescopic mast arms, that the distributor arm is arranged pivotally about a transverse axis which is perpendicular with respect to the telescopic axis, and a longitudinal axis which is perpendicular with respect to the transverse axis, on the distribution mast, and that the conveyor line is fastened to the end of the distribution mast on the side of the distributor arm, and can be taken along during the telescoping operation in accordance with the telescopic extension, and can thereby be automatically wound up and unwound and/or can be retracted and extended and/or can be folded and unfolded.

A preferred embodiment of the invention provides that the conveyor line, which is at least partly designed as a flexible hose, can be wound automatically onto a hose drum arranged on the rotary column and can be unwound from said drum in accordance with the telescopic extension of the distribution mast. The hose drum has advantageously a motor-driven, in particular hydraulic rotary drive acting in the winding-up direction.

It is also possible as an alternative thereto that the conveyor line consists of at least two longitudinally telescoped line sections which can be automatically retracted and extended during telescoping of the distribution mast.

A further modification of the invention provides that a rigid pipe assembly is arranged between the telescopic mast arms, preferably between the ends of the first and the second mast arms, which ends do not face one another, which pipe assembly forms a part of the conveyor line, and has scissor-like foldable and unfoldable pipe elements.

The conveyor line has advantageously a pipe coupling at its end on the side of the distributor arm for connection to a concreting pipe or a concreting window of a tunnel form. In order to as much as possible be able to reach all connection points in a form carriage from one fixed position of the chassis outside of the form carriage, the distribution mast with its telescopic axis can be advantageously pivoted about the horizontal axis of the rotary column between a position pointing approximately 10° to 20° inclined downwardly and a position pointing approximately vertically upwardly.

According to an advantageous further development of the invention, the distributor arm is arranged on a work platform or work cabin which is hinged to the end of the last mast section on the side of the distributor arm and is rotatable about a vertical axis. The conveyor line can there at its end on the side of the distributor arm be equipped with a concrete-spraying nozzle preferably loaded with compressed air, with which nozzle, for example during the advancing of the tunnel, sprayed concrete can be applied for the temporary stabilizing of the interior surface on the tunnel.

The concrete is advantageously supplied through a concrete pump and a material-feeding container which can both be arranged directly on the chassis.

To increase the reach of the distribution mast and of the distributor arm, it is also possible to assemble the distributor arm out of the least two longitudinally telescopic arm sections.

BRIEF DESCRIPTION OF THE DRAWINGS

The invention will be discussed in greater detail hereinafter in connection with some exemplary embodiments schematically illustrated in the drawings, in which.

DETAILED DESCRIPTION

Figure 1:
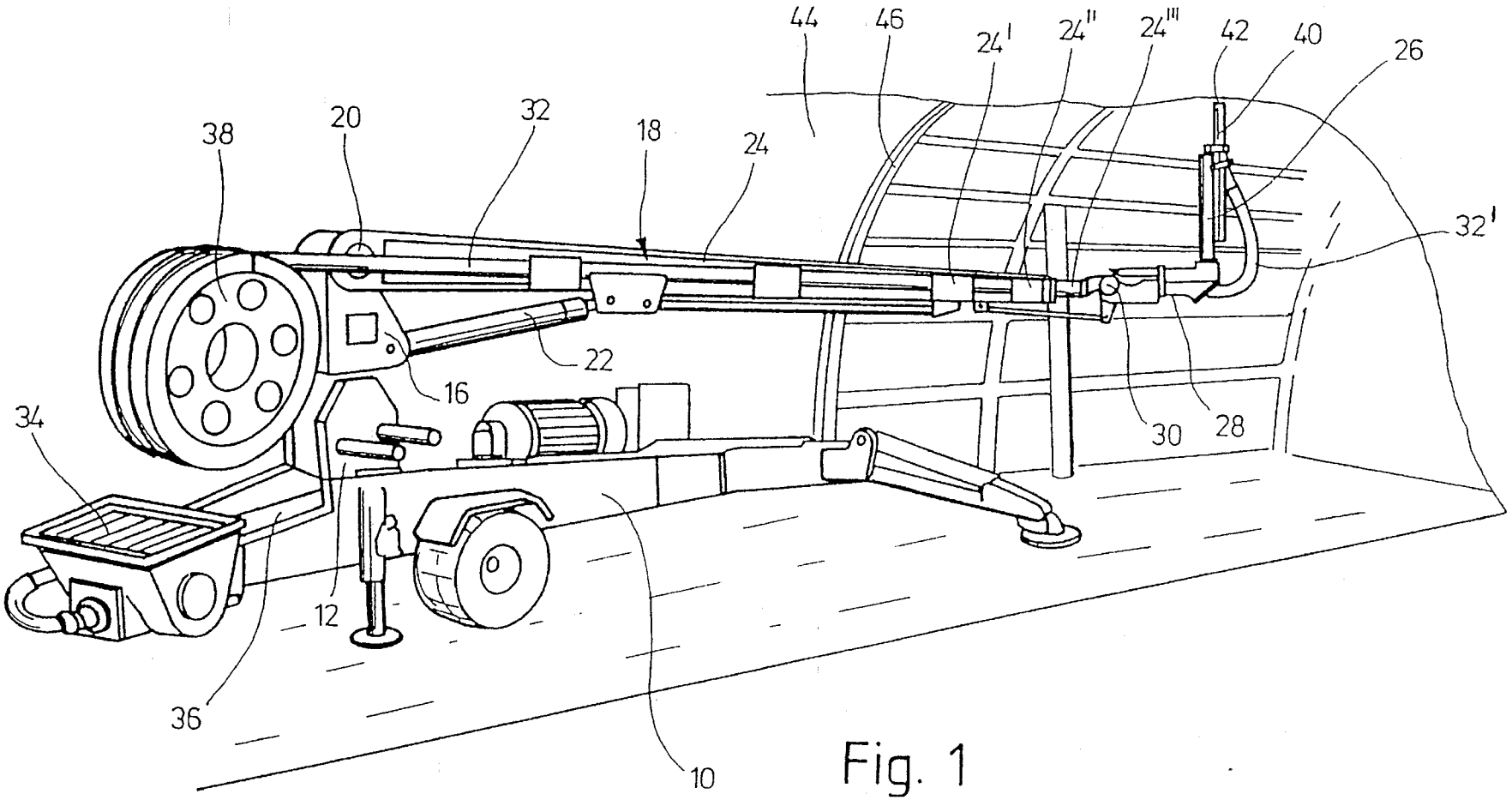
FIG. 1 is a perspective view of a travelling tunnel-concreting device with a telescopic distribution mast and a hose drum.
Figure 2:
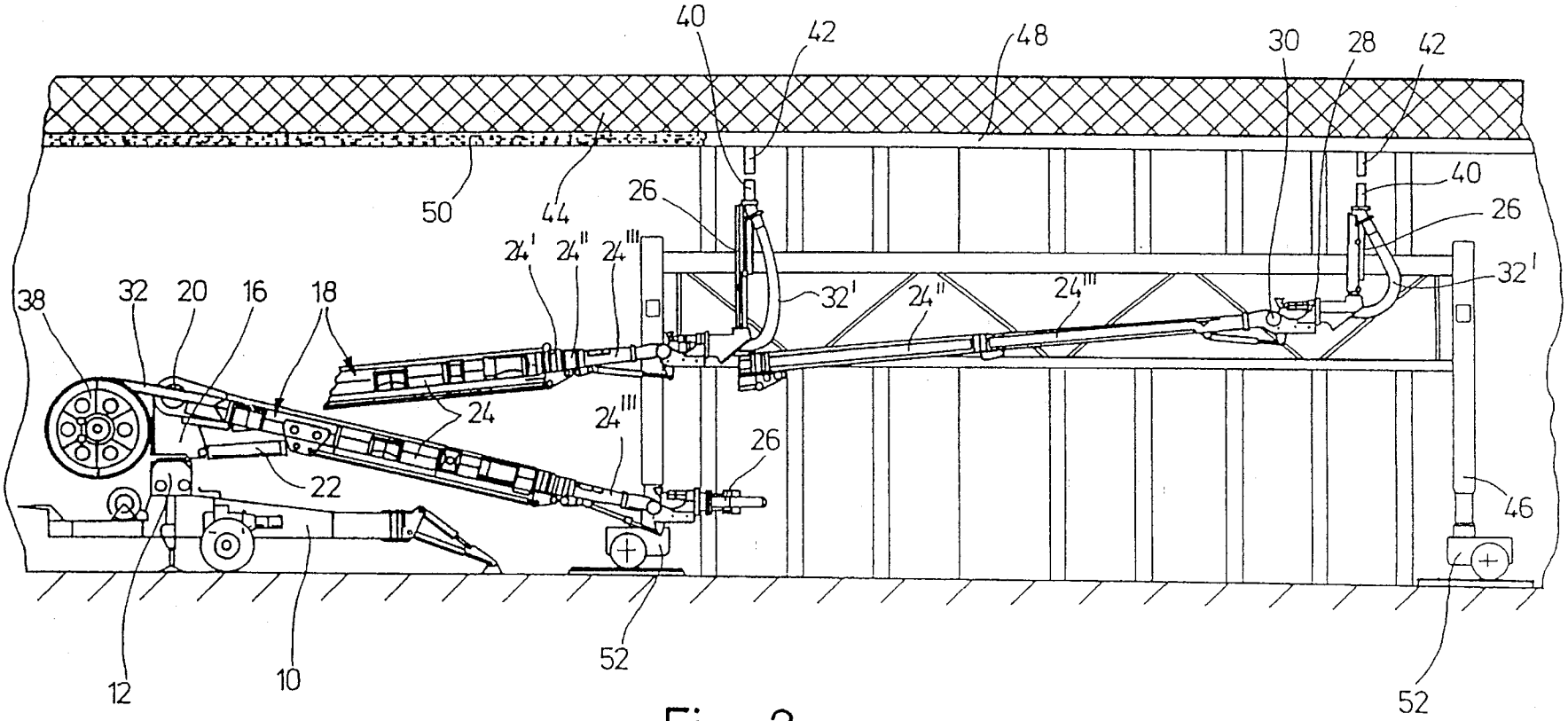
FIG. 2 is a side view of the concreting device in a tunnel with a form carriage in two operating stages.
Figure 3:
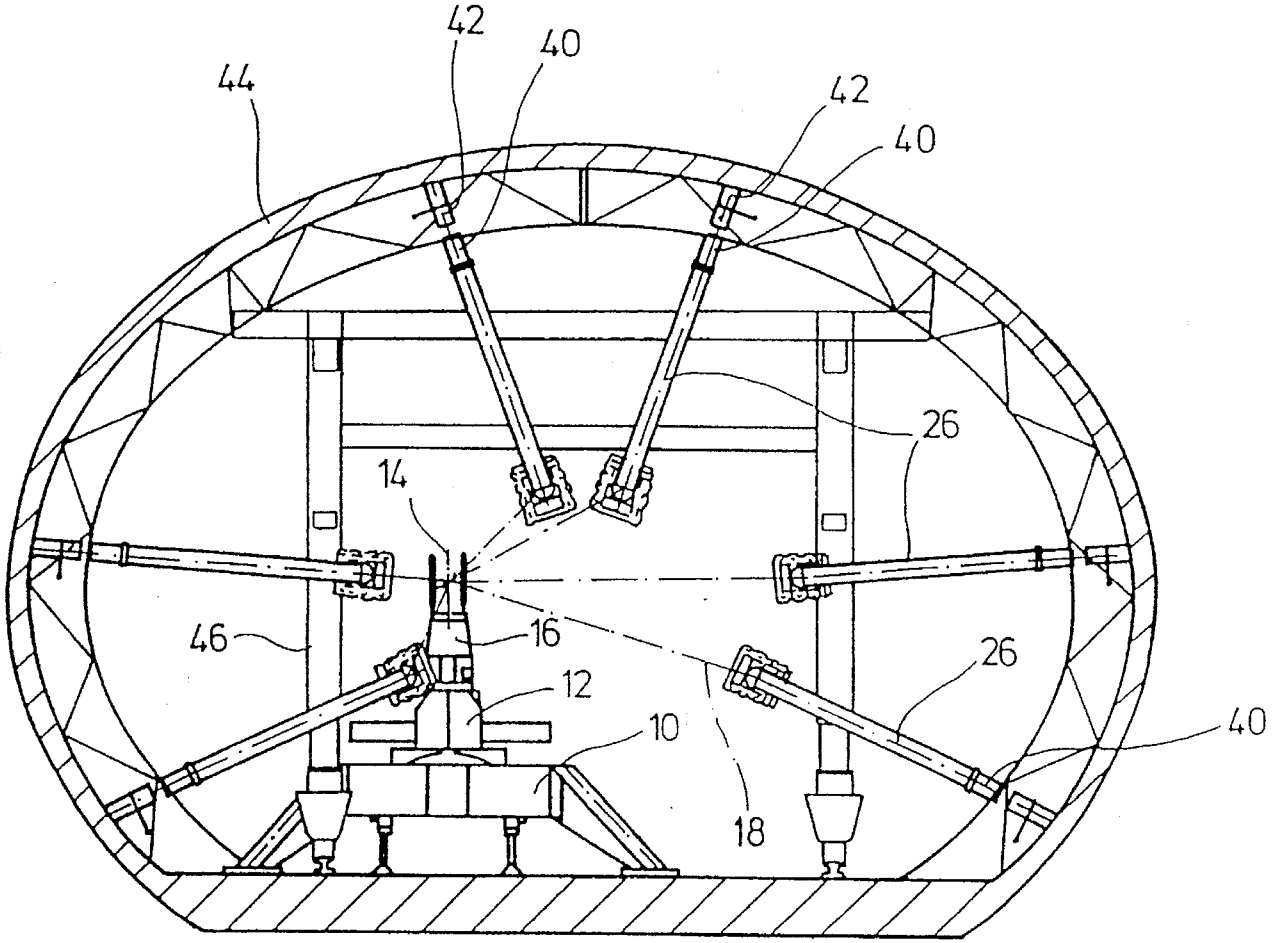
FIG. 3 is a front end view of the concreting device in various operating positions of the distributor arm.

The travelling concreting devices illustrated in the drawings have, for example, a chassis 10 designed as a two-wheel trailer. It is basically also possible to use in place of the two-wheel trailer other chassis, for example, a four-wheel trailer a self-driving chassis with a wheel or caterpillar-like chassis or a truck chassis.

The chassis 10 has a rotary column 16 rotatable about a vertical axis 14 on a stationary base 12, on which rotary column a distribution mast 18 is pivotally supported about a horizontal axis 20 by means of a hydraulic cylinder 22. The distribution mast 18 is in the illustrated exemplary embodiments designed as a four-arm telescopic mast which consists of a main arm 24 and three telescopic arms 24', 24", 24'". A distributor arm 26 exists at the free end of the last telescopic arm 24'", which distributor arm is pivotal, for example, at ±30° about a transverse axis 30 extending perpendicular to the telescopic axis, and at about 360° about a longitudinal axis 28 extending perpendicular to said transverse axis. A concrete-conveying line 32, 32' extends along the distribution mast 18 and the distributor arm 26, which concrete-conveying line can be loaded with concrete through a material-feeding container 34 and a concrete pump 36. The conveyor line 32 is in the case of FIGS. 1 to 4 designed as a flexible hose, which is partially wound up on a hose dream 38 arranged on the rotary column 16. The conveyor line 32 is pulled off from or wound up onto the hose drum 38 during telescoping of the telescopic arms 24', 24", 24'". The latter takes place automatically through a hydraulic rotary drive (not illustrated in the drawing) engaging the hose drum 38 and assuring that the conveyor hose is under a constant tension so that it does not sag, bend or fold up between the individual layers when the telescopic arms 24', 24", 24'" are retracted. The conveyor line 32 extends with its bent end section 32' over the distributor arm 26.

The conveyor line 32' terminates in the exemplary embodiments illustrated in FIGS. 1 to 3 and 5 in a mouth piece 40 connected to the feed pipe 42 on a form carriage 46 arranged in the tunnel 44. As can be seen from FIGS. 2 and 3, it is possible to reach from the chassis 10 positioned in the tunnel behind the form carriage 46 all feed pipes 42 arranged in longitudinal and peripheral direction of the path of the form carriage 46 by pivoting the main arm 24 about the horizontal axis 20, by operating the telescopic arms 24', 24", 24'" and by pivoting the distributor arm 26 about the axes 28 and 30. As can be seen from FIG. 2, it is possible, in order to increase the extension capability, to in addition telescopically extend also the distributor arm 26. After hardening of the concrete 50 filled into the closed-off mold cavity 48, the form carriage 46 is moved forward on its undercarriage 52 a ways in longitudinal direction of its path with a periodic lifting of its form away from the wall of the tunnel. The chassis 10 with the concreting device thereon is also subsequently moved into a new operating position relative to the form carriage 46.

Figure 5:
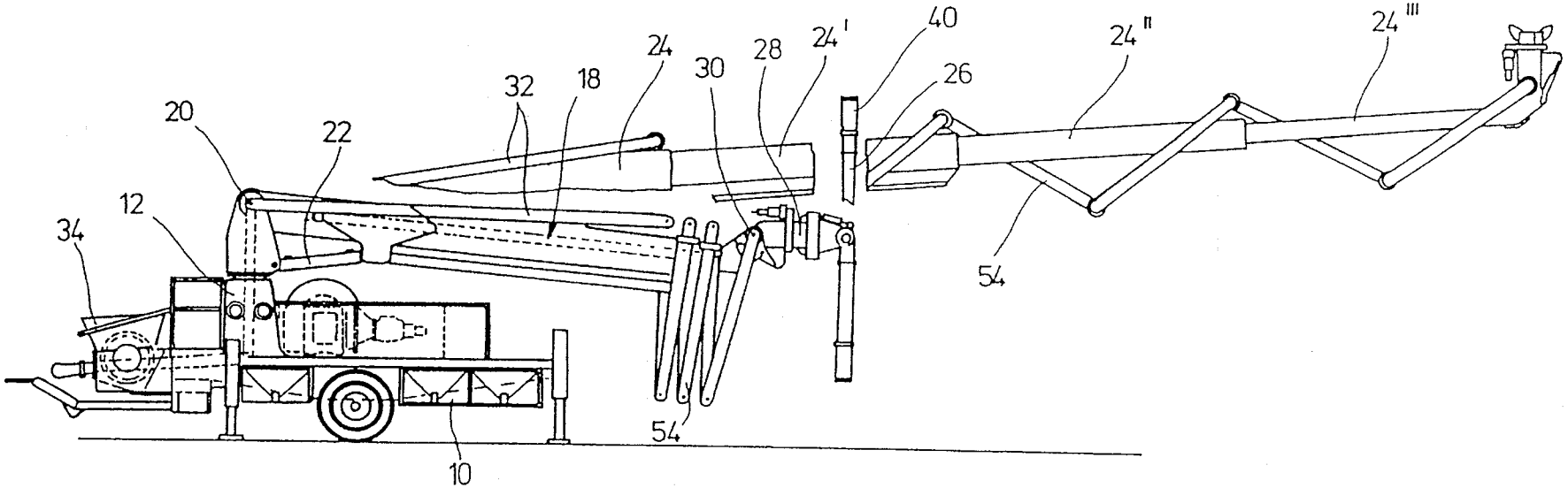
FIG. 5 is a side view of a concreting device with a four-arm telescopic mast and a hose assembly.

The conveyor line 32 has, in the exemplary embodiment illustrated in FIG. 5, instead of a hose drum 38 with a wound-up conveyor hose, a foldable rigid pipe assembly 54 arranged between the telescopic arms 24', 24", 24'" and which can be unfolded when being extended.

Figure 4:
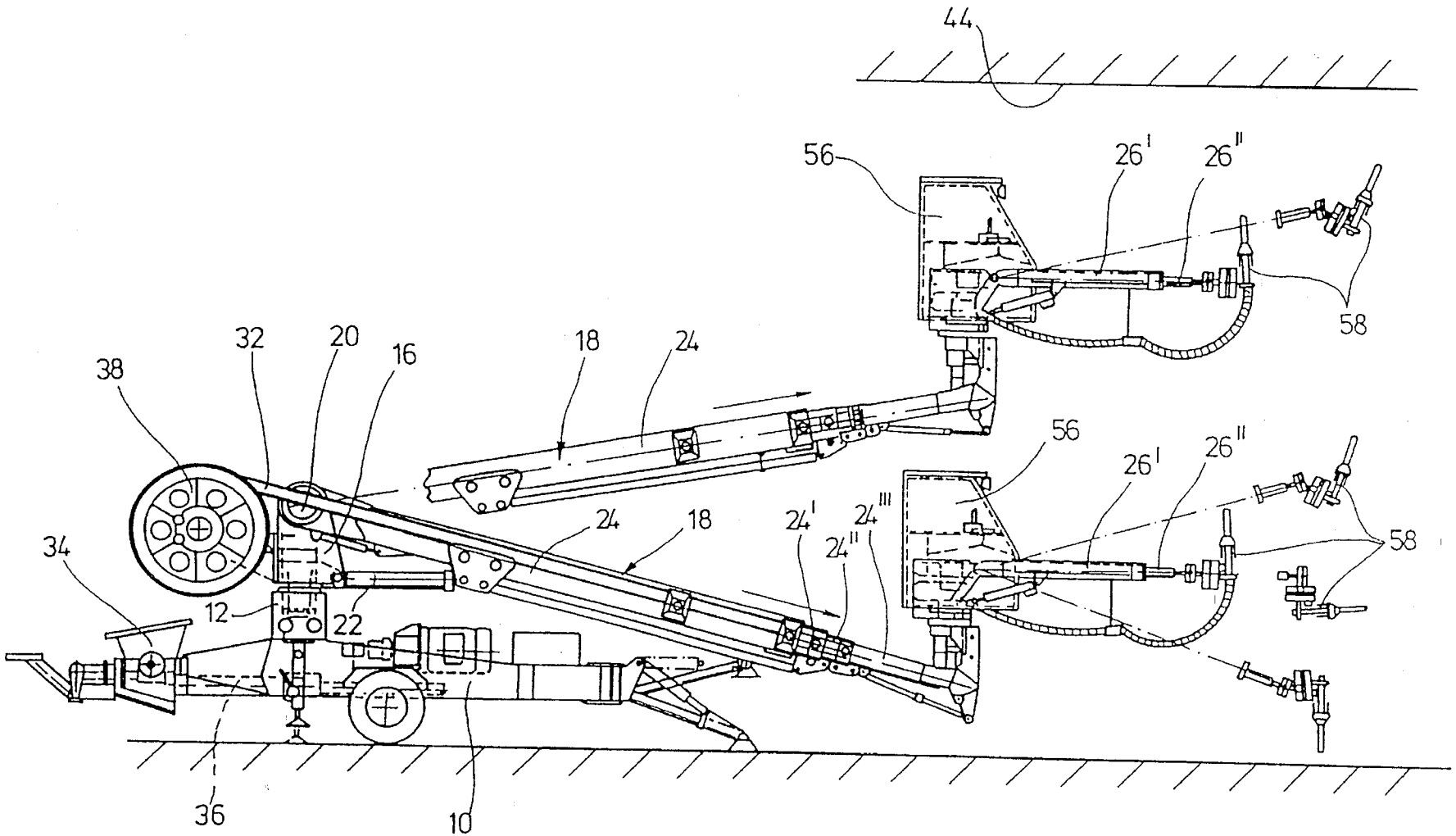
FIG. 4 is a side view of a concreting device with a work cabin and a concrete-spraying nozzle in various operating positions.

A work cabin 56 with an automatic level regulator is hinged to the end of the last telescopic arm 24'" in the exemplary embodiment illustrated in FIG. 4, which cabin can be rotated about a vertical axis. A telescopic distributor arm 26', 26" is hinged to the work cabin, on the telescopic arm 26" of which distributor arm is pivotally arranged a pneumatic concrete sprayer 58 loaded with concrete through the conveyor line 32'. The concrete sprayer 58 is intended for the temporary stabilizing of the interior surface of the tunnel with fine concrete during advancing of the tunnel construction. The telescopic distribution mast 18 permits here also for work to be done in a very small area at low tunnel heights.

In conclusion the following is to be stated: The invention relates to a concreting device with a rotary column 16 pivotal about a vertical axis 14 on a chassis 10, a distribution mast 18 pivotal about a horizontal axis on the rotary column 16, and having at least two elongated mast arms 24, 24', 24", 24'" movable relative to one another, a distributor arm 26 hinged to the free end of the distribution mast 18, and a conveyor line 32, 32' for concrete, which conveyor line extends from the rotary column 16 to the distributor arm 26 along the distribution mast 18. In order to be able to use the concreting device also in low tunnel construction sites, the distribution mast 18 consists of at least two mast arms 24, 24', 24", 24'" which can be extended in their longitudinal direction, whereas the distributor arm 26 is arranged pivotally about a transverse axis 30 perpendicular with respect to the telescopic axis, and about a longitudinal axis 28 perpendicular thereto on the distribution mast 18 The conveyor line 32, 32' which is designed at least partly as a flexible hose, can be automatically wound onto a hose drum 38 arranged on the rotary column 16 and can be automatically unwound from it in accordance with the telescopic extension of the distribution mast 18.

I claim:

1. In a concreting device including a chassis, a rotary column and first support means for rotatably supporting said rotary column for movement about a vertical axis on said chassis, a distribution mast and a second support means for pivotally supporting said distribution mast for movement about a horizontal axis on said rotary column, said distribution mast having a free end, a distributor arm and third support means intermediate said free end and said distributor arm for pivotally supporting said distributor arm for movement about a transverse axis which is perpendicular with respect to a longitudinal axis of said distribution mast, and about said longitudinal axis of said distribution mast which is perpendicular with respect to said transverse axis, a conveyor line for the concrete extending from said rotary column to said distributor arm along said distributor mast with an extension means for moving said conveyor line along with said distribution mast, the improvement wherein said distribution mast has at least two longitudinally telescopic mast arms which are movable relative to each other, wherein said conveyor line includes a flexible hose, and wherein a hose drum is rotatably mounted on said rotary column and has said flexible hose wound thereon, said flexible hose being unwound automatically from said drum in response to a telescopic extension of said distribution mast.

2. The concreting device according to claim 1, wherein said hose drum has a motor-drive acting in a winding-up direction.

3. The concreting device according to claim 2, wherein said motor-drive consists of a hydraulic rotary drive.

4. The concreting device according to claim 1, wherein a work platform with an automatic level regulator and a fourth support means is provided for pivotally supporting said work platform for movement about a transverse axis of said distribution mast on a last of said at least two longitudinally telescopic mast arms, and wherein a further telescopic distributor arm and a fifth support means are provided for pivotally supporting said further telescopic distributor arm on said work platform.

5. The concreting device according to claim 4, wherein said work platform is a work cabin.

6. The concreting device according to claim 1, wherein said conveyor line has a pipe coupling piece at an end said distributor arm for connection to a feed pipe of a tunnel form.

7. The concreting device according to claim 1, wherein said conveyor line has a concrete-spraying nozzle at an end of said distributor arm.

8. The concreting device according to claim 7, wherein said concrete-spraying nozzle is loadable with compressed air.

9. The concreting device according to claim 1, wherein a concrete pump, which is supplied with concrete through a material-feeding container, is arranged on said chassis.

10. The concreting device according to claim 1, wherein said distributor arm consists of two longitudinally telescopic arm sections.

11. The concreting device according to claim 1, wherein said distribution mast with said telescopic mast arms can be vertically pivoted on said rotary column between a position pointing approximately 10° to 20° downwardly inclined and a position pointing generally vertically upwardly.

* * * * *